US006537140B1

(12) United States Patent
Miller et al.

(10) Patent No.: US 6,537,140 B1
(45) **Date of Patent: *Mar. 25, 2003**

(54) PATTERNED ABRASIVE TOOLS

(75) Inventors: Bradley J. Miller, Westboro, MA (US); Roland Mabon, Paris (FR)

(73) Assignee: Saint-Gobain Abrasives Technology Company, Worcester, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/856,501

(22) Filed: May 14, 1997

(51) Int. Cl.[7] ..... B24D 11/00
(52) U.S. Cl. ..... 451/259; 451/527; 451/534
(58) Field of Search ..... 451/259, 449, 451/527, 520, 534; 51/293, 307, 309

(56) References Cited

U.S. PATENT DOCUMENTS 2,978,846 A * 4/1961 Barron ..... 451/541
3,510,990 A * 5/1970 Steindler ..... 451/541
4,078,906 A 3/1978 Green ..... 51/295
5,151,109 A 9/1992 Kitabayashi et al. ..... 51/297
5,181,939 A * 1/1993 Neff ..... 51/298
5,251,802 A 10/1993 Bruxvoort et al. ..... 228/121

* cited by examiner

*Primary Examiner*—Robert A. Rose
(74) *Attorney, Agent, or Firm*—Mary E. Porter

(57) ABSTRACT

An method of making a metal bonded, abrasive tool uses a perforated stencil to place abrasive parcels in a pattern on the cutting surface of the tool. The stencil is placed against the tool preform so that the perforations define cavities. Metal brazing composition in the form of a paste is packed into the cavities and the stencil is removed to leave discrete parcels of brazing paste tacked to the cutting surface. Abrasive grains are deposited onto the paste particles and fixed in place by firing the preform at brazing conditions. The abrasive grains thus are precisely positioned and spaced apart on the cutting surface by abrasive free channels which are defined by the web of the stencil. The abrasive free channels provide paths to facilitate flow of coolant material and swarf particles at the cutting zone.

The method can include initially placing the brazing paste parcels onto a resilient, transfer medium and subsequently transferring the parcels onto the preform cutting surface. This method is particularly useful for depositing an abrasive pattern on a non-planar or highly curved tool surface. In another contemplated variation of the invention, the abrasive grains are premixed with the brazing paste prior to filling the cavities.

20 Claims, 1 Drawing Sheet

PATTERNED ABRASIVE TOOLS

FIELD OF THE INVENTION

This invention relates to the manufacture of abrasive tools. More specifically, it relates to making tools with abrasive grains disposed in discrete parcels separated from neighboring parcels on the cutting surface by open channels. The invention further relates to self-sharpening abrasive tools in which the abrasive parcels are formed from multiple, ultrafine abrasive grains embedded therein.

BACKGROUND AND SUMMARY OF THE INVENTION

In certain abrasive tools for industrial applications abrasive grains are affixed to a metal preform. The grains are attached to the preform by brazing a metal bonding composition at temperatures above about 600° C.

Removing swarf from the cutting zone during grinding improves performance. Among other things, swarf removal reduces wear of the brazed bonding composition and premature dulling of the abrasive grains. Cooling the work piece is another way abrasive tool users obtain improved grinding performance. Often cooling is accomplished by bathing the work piece in a cool, liquid lubricant. By providing open spaces on the abrasive tool, manufacturers can enhance swarf removal and cooling efficiency. These open spaces provide paths for swarf to leave the cutting zone and conduct coolant to and from the work piece.

A typical method of creating swarf removal and coolant spaces involves cutting grooves or drilling holes through the preform. This technique is widely used in abrasive wheel manufacture. In segmented abrasive tool fabrication, channels can be created by placing gaps between abrasive segments. Normally, such segments are molded from mixtures of abrasive grains and bonding composition and then attached as units to the tool. These methods add to the complexity of the manufacturing operation, are time consuming, and add to product cost.

It is desirable to provide an efficient method of making an abrasive tool with swarf removal and cooling space. Some methods for placing abrasive grains in discrete locations separated by open space on an abrasive tool have been suggested.

U.S. Pat. No. 5,389,119 (Ferronato et al.) discloses a method of making a nonwoven fabric with discrete islands of abrasive bound to a porous fabric layer. The islands are created by masking portions of a conductive fabric layer and electro-depositing or electroplating a metal structure which contains abrasive material in isolated, unmasked spots.

U.S. Pat. No. 4,826,508 (Schwartz et al.) teaches a method of forming a flexible abrasive member which includes applying a flexible mask of non-electrically conductive material having a multitude of discrete openings therein to one side of a flexible fabric, placing the fabric with the mask applied in a metal deposition bath, and depositing metal directly in the discrete openings in the presence of particulate abrasive material such that the metal adheres directly to the fabric and the abrasive material becomes embedded in the metal deposits.

U.S. Pat. No. 4,047,902 (Wiand) discloses a method of manufacturing a metal-plated abrasive product which entails providing a conductive or metallic backing member, masking off predetermined desired surface portions thereof to leave exposed, spaced-apart portions on the backing, and bonding abrasive grit particles to the exposed portions. The bonding is carried out by a metal plating process.

U.S. Pat. No. 4,863,573 (Moore et al.) teaches a method of making an abrasive article by screen printing a non-conductive mesh with non-electrically conductive ink. The mesh is passed through an electroplating bath while in contact with an electrically conductive cylinder or metal band. A first, nearly complete thickness of metal is electrodeposited onto the non-printed areas of the mesh. Then abrasive particles are deposited on the metal and a second, outer layer of metal is electrodeposited onto the first thickness of metal. The abrasive particles thus are captured by the outer layer of metal and lie at the surface of the metal.

U.S. Pat. No. 4,874,478 (Ishak et al.) provides a method of making an abrasive member comprising attaching a metal film to one surface of a flexible sheet, applying a mask of plating resistant material having a multitude of discrete openings to the exposed surface of the film and depositing metal directly through the openings into the metal film in the presence of particulate abrasive so that the metal adheres to the film and embeds the abrasive in the metal deposits.

Each of the foregoing references relates to manufacture of flexible abrasive fabric or film. Although these abrasive articles might be laminated to supporting substrates to form coated abrasive products, they generally cannot be used by themselves in many industrial grinding applications. Fabric or film-borne abrasive tools will not hold up in aggressive grinding of construction materials, such as steel and concrete. Additionally, each referenced method employs electro-deposition or electroplating to attach the abrasive to the fabric. Such methods of attachment do not usually provide sufficient thickness of bond material to endure in demanding, industrial grinding applications.

Other approaches to incorporating open space in an abrasive matrix have been disclosed. U.S. Pat. No. 4,882,878 (Benner) describes a grinding wheel having a rigid, continuous abrasive-bearing matrix. The matrix has a plurality of spaced apertures extending into the wheel from the grinding surface. Preferably the matrix is of an organic binding material.

International Patent Application WO 96/26811 (Ferronato) discloses a flexible abrasive member having a backing layer on one side and deposits of abrasive particles and bonding material on the other side. The article further includes a permanent one way mold substantially encircling the deposits and extending along at least part of the height of the deposits. The deposits are placed in holes of the flexible abrasive member.

U.S. Pat. No. 5,152,917 (Pieper et al.) teaches the method of making a structured, coated abrasive article comprising a backing bearing a plurality of abrasive composites having precise shape and disposed in a non-random array. The method includes introducing a slurry of binder precursor and abrasive grains into cavities on the outer surface of a production tool. A backing is placed over the outer surface such that the slurry wets one major surface of the backing to form an intermediate article. The binder precursor is then cured before the intermediate article departs from the outer surface of the production tool. The binder precursor is a quick setting, curable or thermoplastic organic resin.

The prior art does not satisfy the need for a metal preform abrasive tool for aggressive grinding applications in which discretely spaced apart abrasive elements are strongly attached to the preform with a brazeable metal bonding composition. Accordingly, there is provided a process for making an abrasive tool comprising the steps of:

(A) providing a stencil having a plurality of perforations of selected shape;

(B) contacting a cutting surface on the abrasive tool with the stencil whereby the perforations define cavities adjacent the cutting surface;

(C) providing a brazing paste including a metal braze composition and a binder component;

(D) filling the cavities with brazing paste;

(E) removing the stencil to form parcels of brazing paste on the cutting surface, each parcel being separated from neighboring parcels by paste-free channels;

(F) depositing abrasive grains onto the parcels; and (G) thermally processing the abrasive tool to braze the abrasive grains to the cutting surface.

In another aspect, the present invention provides a process for making a metal preform abrasive tool in which selectively shaped and spaced apart parcels of brazing paste are first formed on a transfer medium. The brazing paste parcels are then transferred to the cutting surface of a metal preform where abrasive grains are added and brazing is accomplished. This method facilitates the manufacture of oddly-shaped and curved cutting surface abrasive tools. There is thus provided a process for making an abrasive tool comprising the steps of:

(A) providing a stencil having a plurality of perforations of selected shape;

(B) contacting a transfer medium with the stencil whereby the perforations define cavities adjacent the transfer medium;

(C) providing a brazing paste including a braze composition and a binder component;

(D) filling the cavities with brazing paste;

(E) removing the stencil to form a patterned face of parcels of brazing paste on the transfer medium, each parcel being separated from neighboring parcels by paste-free channels;

(F) forcing the patterned face against a cutting surface of the abrasive tool;

(G) peeling the transfer medium away to leave the parcels on the cutting surface;

(H) depositing abrasive grains onto the parcels; and (I) thermally processing the abrasive tool to braze the abrasive grains to the cutting surface.

DETAILED DESCRIPTION

Figure 1:
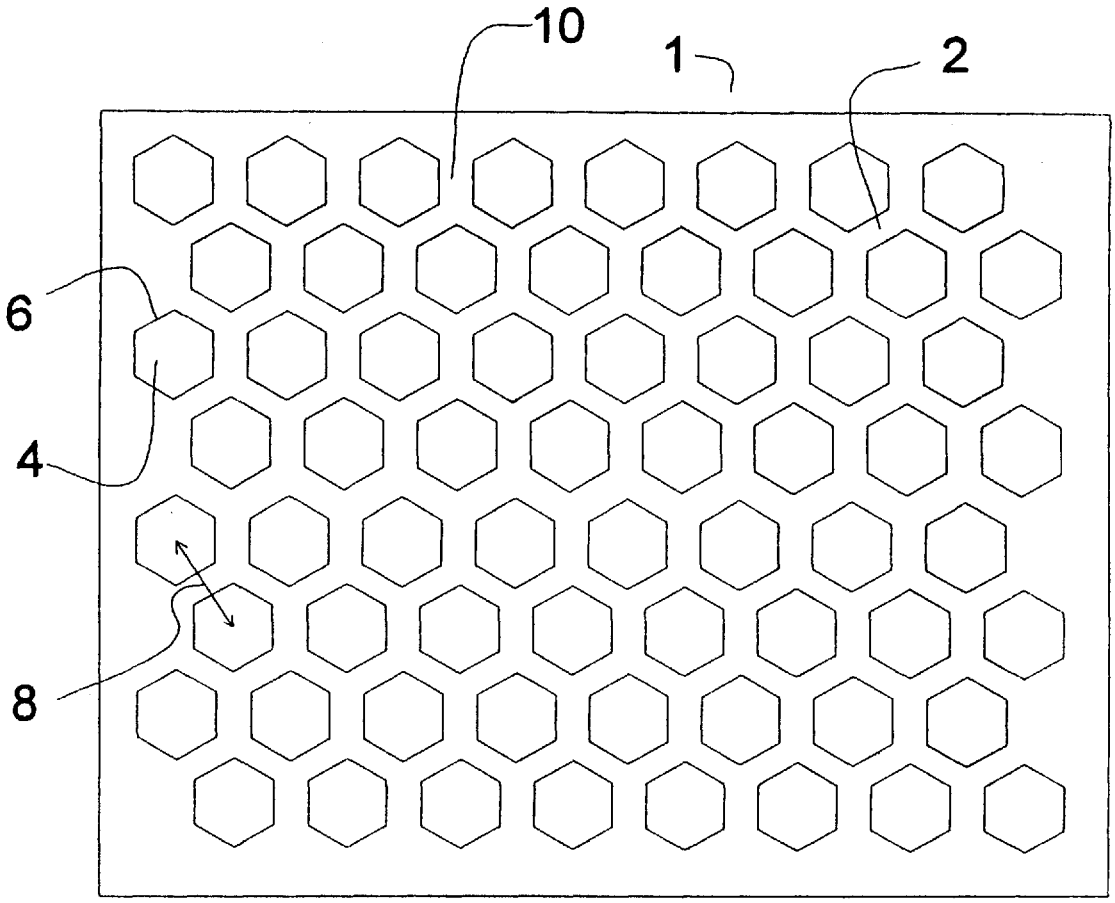
FIG. 1 is a plan view of a mask for creating a stencil useful in the practice of the present invention.

The present invention is useful for fabricating abrasive tools in which abrasive grains are metal-bonded onto metal, primarily ferrous metal, preforms. The method can be used with a diverse variety of preform shapes. Representative preforms include flat disks, drill bit cores, abrasive wheel rims, saw blades and many specialty tool bodies, such as spherical, conical, and frustoconical-shaped preforms. The abrasive tools made according to thins invention thus will be rugged and suitable for demanding industrial and construction material grinding and cutting applications.

The abrasive grains will be of a substance that is harder than the substance being cut. Very hard abrasive substances generally known as superabrasives, such as diamond, cubic boron nitride and mixtures of them can be used. Among these, diamond is preferred, primarily for cutting nonferrous materials. Many non-superabrasive substances also can be employed. Representative non-superabrasives which can be used in this invention include aluminum oxide, silicon carbide, tungsten carbide, and the like. Aluminum oxide encompasses standard alumina abrasive as well as seeded and unseeded sol-gel microcrystalline alumina, described in greater detail, below.

A preferred non-superabrasive is a microcrystalline alumina. Also preferred are the sol-gel alumina filamentary abrasive particles described in U.S. Pat. Nos. 5,194,072 and 5,201,916, incorporated herein by reference. "Microcrystalline alumina" means sintered sol-gel alumina in which the crystals of alpha alumina are of a basically uniform size which is generally smaller than about 10 $\mu$m, and more preferably less than about 5 $\mu$m, and most preferably less than about 1 $\mu$m in diameter. Crystals are areas of essentially uniform crystallographic orientation separated from contiguous crystals by high angle grain boundaries.

Sol-gel alumina abrasives are conventionally produced by drying a sol or gel of an alpha alumina precursor which is usually but not essentially, boehmite; forming the dried gel into particles of the desired size and shape; then firing the pieces to a temperature sufficiently high to convert them to the alpha alumina form. Simple sol-gel processes for making grain suitable for use in accordance with the present invention are described, for example, in U.S. Pat. Nos. 4,314,827; 4,518,397 and 5,132,789; and British Patent Application 2,099,012, the disclosures of which are incorporated herein by reference.

In one form of sol-gel process, the alpha alumina precursor is "seeded" with a material having the same crystal structure as, and lattice parameters as close as possible to, those of alpha alumina itself. The "seed" is added in as finely divided form as possible and is dispersed uniformly throughout the sol or gel. It can be added ab initio or it can be formed in situ. The function of the, seed is to cause the transformation to the alpha form to occur uniformly throughout the precursor at a much lower temperature than is needed in the absence of the seed. This process produces a crystalline structure in which the individual crystals of alpha alumina are very uniform in size and are essentially all sub-micron in diameter. Suitable seeds include alpha alumina itself but also other compounds such as alpha ferric oxide, chromium suboxide, nickel titanate and a plurality of other compounds that have lattice parameters sufficiently similar to those of alpha alumina to be effective to cause the generation of alpha alumina from a precursor at a temperature below that at which the conversion normally occurs in the absence of such seed. Examples of such seeded sol-gel processes are described in U.S. Pat. Nos. 4,623,364; 4,744,802; 4,788,167; 4,881,971; 4,954,462; 4,964,883; 5,192,339; 5,215,551; 5,219,806; and 5,453,104, the disclosures of which are incorporated herein by reference, and many others.

Preferably the abrasive grains are attached to the metal preform by a bond containing metal. The bond is formed from a metal braze composition which is thermally treated according to a conventional, high temperature brazing process. Metal braze compositions for uniting abrasive to a metal tool preform are well known. Illustrative metal braze compositions include silver, nickel, zinc, lead, copper, tin and mixtures of these metals alloyed with other metals, such as phosphorous, cadmium, vanadium and the like. Generally minor amounts of additional components can be included in the braze composition to modify the properties of the bond during and after brazing, such as to modify melting temperature, melt viscosity, abrasive surface wetting and bond strength. Copper/tin bronze-based alloys are preferred for bonding abrasives, especially superabrasives to metal. Certain so-called "active metals" or "reactive metals" including titanium, tantalum, chromium, and zirconium, for example, can be added to the braze composition particularly for bonding diamond. These metals react with the carbon to form carbides and thereby improve the wetting of the braze composition on the superabrasive particle. Hybrid bond material such as a metal filled resinoid braze composition containing a major fraction of metal can also be used with the present invention.

Brazing is performed at elevated temperatures selected with consideration to numerous system parameters such as solidus-liquidus temperature range of the metal brazing composition, geometry and material of construction of the preform and physical properties of the abrasive. For example, diamond can graphitize at temperatures above about 1000° C. in air and above about 1200° C. under vacuum or inert atmosphere. Hence, it is often desirable to braze at the lowest possible temperatures. The metal brazing composition should be selected to braze preferably at about 800–1025° C., and more preferably, at about 850–950° C.

The metal braze composition is usually employed in fine particulate form. The components of the metal braze composition can be present as prealloyed particles, as a mixture of separate component powders or a combination of both forms. The metal braze composition can be conveniently delivered to the braze site in paste form by mixing a liquid binder with the dry particulate components. The liquid binder facilitates blending of the dry particulate components to uniform composition and provides a vehicle for dispensing precise amounts of metal braze composition.

The liquid binder should be sufficiently volatile to evaporate or pyrolize below the melting temperature of the metal braze composition so as not to interfere with the formation of a secure bond between abrasive and preform. However, the volatility should not be so great that the paste dries too quickly. The paste should remain fluid for a reasonable time to permit assembly of the abrasive tool. Preferably, the paste should be fluid for at least several minutes and up to about an hour at ambient temperature and humidity conditions. Liquid binders are well known in the industry. Representative paste-forming binders suitable for use in the present invention include Braz™-Binder Gel from Vitta Company; "S" binder from Wall Colmonoy Corporation, Madison Heights, Mich.; and Cusil-ABA, Cusin-ABA, and Incusil-ABA pastes from Wesgo, Belmont, Calif. Active metal braze composition pastes including binder premixed with metal braze composition components can be obtained from Lucas-Millane Company, Cudahy, Wis. under the Lucanex™ tradename, such as Lucanex 721.

The present invention uses a stencil to place abrasive parcels in a pattern on the abrasive tool. Generally, the stencil is a flat sheet structure. The sheet can be flexible which permits it to conform to a curved cutting surface and to be rolled up for storage or for deployment in an endless belt configuration.

The stencil material should be capable of being perforated with a plurality of precisely positioned, selectively shaped holes. Perforating can be done by any well known technique, such as stamping with a die, photoetching, drilling and cutting. Stainless steel sheet can be reused repeatedly, is wear resistant, is generally not affected by a wide range of chemicals, and therefore, is a preferred stencil material. For one-time or limited reuse stencils, disposable material, such as plastic film and fiberboard sheeting, also is contemplated to fall within the scope of this invention.

The perforations will extend completely through the stencil. Shape and placement of the perforations determine the size and location of abrasive parcels on the tool. Any regular or non-regular geometric, area-enclosing shape can be employed. Uncut regions of the stencil correspond to open channels on the tool between abrasive parcels.

In use, one side of the stencil is brought in contact with the tool preform adjacent the cutting surface. The other side of the stencil remains exposed. The interior walls of the perforations and the cutting surface within the perimeters of the perforations define vacant cavities. On the exposed side of the stencils, the cavities are open.

The cavities are filled with brazing paste. Filling preferably is accomplished by forcing the paste into the cavities with a squeegee-like tool. That is, a thick bead of brazing paste is dispensed on the exposed side of the stencil, generally at one end of the cutting surface. The bead length extends slightly beyond the width of the cutting surface. A straight edged blade longer than the bead length is drawn with slight pressure from behind the bead across the exposed side of the stencil. The blade forces the paste into the cavities and removes the excess paste above the cavities flush with the exposed side of the stencil. The blade also wipes away excess paste from the exposed side of the stencil for reuse or disposal.

It is seen that the thickness of the stencil sheet will determine the height of the abrasive parcels on the tool. The thickness can vary widely to suit the needs of a particular grinding application. Generally, the thickness will be about equal to the maximum cross section dimension of the abrasive particles, although a different thickness can be used, especially if the binder concentration of the brazing paste varies outside the range of about 20–25 wt %. One can also appreciate that the size of the metal braze composition particles should be small enough to form a smooth paste that will flow into the cavities. Particle size of 325 U.S. standard mesh or smaller, i.e., at most 44 $\mu$m, is generally suitable.

The stencil is peeled away from the cutting surface. The parcels of brazing paste remain stuck to the cutting surface. Thus the brazing paste is disposed on the cutting surface in discrete islands separated from neighboring parcels by paste-free channels.

In one aspect, abrasive grains are deposited onto the still soft parcels of abrasive paste. Grains can be placed individually or dusted over the whole surface. In an embodiment, abrasive grains are at least about 100 $\mu$m and only one abrasive grain is deposited onto each of most parcels. A feeding apparatus can be used to facilitate individual placement of a single abrasive grain in each parcel of paste. Such feeding apparatus also advantageously may orient grain placement to optimize exposure of each grain's cutting facet relative to the workpiece. The fabricator thus can control the tool at the individual grain level to provide maximum cutting speed, minimum energy consumption, minimum grain fracture, or combinations of these parameters. The metal brazing composition will liquefy during brazing. Consequently, it may be necessary to provide means to preserve the orientation of individually placed grains until a permanent bond is formed at the conclusion of brazing. For example, this may be achieved by utilizing a stencil or feeding apparatus of a thermally stable composition, such as graphite or ceramic. The thermally stable stencil or feeding apparatus may be left in place during all or part of the brazing step.

In another embodiment the abrasive grains have a particle size of at most 10 $\mu$m. Preferably, the small grains are dusted onto the cutting surface to embed the grains in the parcels. Excess grains which dust into the paste-free channels are not embedded in the parcels. They can be removed by inverting the preform, by vacuum, by blowing with gas jets or like procedures. After removing excess grains, loosely embedded grains can be further buried in the parcels of paste. The grains can be deeply planted by placing a flexible release film over the parcel-populated cutting surface and applying pressure with a manual or automated roller, for example.

In yet another embodiment, the abrasive grains are premixed with the brazing paste prior to filling the cavities. The premixed grains should be smaller than the cross section dimension of the perforations to permit the grains to enter the cavities. Preferably the premixed grains should be smaller than 75% of the stencil thickness.

Premixing of small grains with the paste can provide a uniform concentration throughout the paste. This technique will embed grains over the complete depth of the parcel. Moreover, the small grains can impart self-sharpening behavior to the premixed parcels. That is, each parcel on the tool will constitute a plurality of abrasive grains bonded within a matrix of metallic braze. Such parcels tend to wear by dislodging the most exposed abrasive grains. This will expose underlying fresh, sharp grains to continue grinding. Consequently, tools fabricated in this manner generally provide consistent, superior grinding performance as the parcels wear away over time in service.

Once the abrasive grains are embedded in the parcels of brazing paste, the preform can be fired by traditional methods. A brazing treatment causes the residual liquid binder to dissipate or burn off at intermediate temperature. At high temperature the metal braze composition components permanently unite the abrasive grains to the preform. Control of the thermal cycle variables permits the braze composition components to sinter without significantly changing the shape or placement of the parcels. One of ordinary skill in the art can select appropriate brazing time and temperature parameter to optimize parcel shape retention.

It is sometimes desirable to create a patterned abrasive on a tool exhibiting non-planar or extreme surface curvature. Deployment of a stencil directly against such a cutting surface may be problematic. In another aspect of this invention, this problem is solved by forming parcels of brazing paste on a transfer medium, and subsequently transferring the parcels to the cutting surface of a metal preform. The transfer medium can be a resilient, rubbery pad that is capable of conforming to the shape of the preform cutting surface. The operative face of the transfer medium preferably has a closed cell, smooth surface structure to facilitate transfer of paste parcels.

According to this variation of the invention, a stencil is provided with a plurality of perforations. Each perforation has a precise shape and is placed apart from neighboring perforations. One side of the stencil is brought in contact with a generally flat sheet of transfer medium while the other side of the stencil remains exposed. The interior walls of the perforations and the transfer medium within the perimeters of the perforations define vacant cavities. On the exposed side of the stencils, the cavities are open. The cavities are filled with brazing paste. Filling preferably is accomplished by forcing the paste into the cavities, as explained above. The stencil is peeled away leaving the parcels of brazing paste stuck to the transfer medium. The parcel-bearing side of the transfer medium is pressed against the cutting surface of a tool preform. This can be accomplished to some advantage by first placing the parcel-free side of the transfer medium on a stable working surface, such as a table top or similar holding structure. The parcel-bearing side of the medium is held stationary and exposed. Then the cutting surface of the preform is forced against the stationary transfer medium. The parcels transfer to the cutting surface. Thereafter, abrasive particles can be added and the tool can be fired to permanently attach the abrasives.

EXAMPLES

Example 1

The example can be better understood with reference to FIG. 1. Mask the surface of a 15 inch long by 15 inch wide by 0.010 inch thick stainless steel sheet with a U.V. impenetrable coating. The mask 1 is a continuous network 2 with exposed regular hexagonal areas 4 of 0.115 inches length on each side 6 and center-to-center distance 8 of 0.32 inches. The gap 10 between neighboring hexagons is 0.12 inches. Photoetch the sheet to open hexagonal perforations at the exposed areas and remove the mask.

Mount the perforated stainless steel stencil to a sturdy, rigid rectangular frame to maintain flatness. Place a 0.030 inch thick, 9.875 inch diameter, flat, circular steel preform for an abrasive disk on a table with the cutting surface facing up. Align the stencil centrally over the disk and clamp the frame to the preform so that the face of the disk contacts one side of the stencil. Maintain the exposed side of the stencil facing up in a horizontal plane.

Dispense an approximately 0.5 inch diameter, 12 inch long bead of Lucanex™ 721 braze paste just inside one edge of the rectangular frame. Use a 14 inch long, hard rubber squeegee to draw the bead in a steady speed stroke across the exposed face of the stencil with slight downward pressure and to force the braze paste into the hexagonal cross-section cavities to a depth flush with the exposed surface of the stencil, i.e., approximately 0.010 inch. Use only a single pass to prevent braze paste from bleeding under the stencil between perforations.

Unclamp the frame from the preform and lift the stencil vertically away from the disk face. Sprinkle 120/140 U.S. mesh type PDA 989 diamond abrasive grains from DAC Company, New York, N.Y. to evenly dust grains over the disk face. Lift the preform from the table and invert to drop excess abrasive grains into a collection pan. Place the abrasive bearing preform cutting surface side up on a horizontal work surface. Align a 0.25 inch thick, 14 inch diameter circular rigid acrylic plastic sheet to overlay the preform and push down evenly to embed the abrasive grains into the braze paste parcels.

Remove the acrylic sheet and fire the preform in a vacuum furnace at about 15° C. per minute to a maximum temperature of about 900° C., while maintaining pressure within the furnace below $10^{-4}$ Torr. Hold the preform at 900° C. for 10 minutes and allow to cool to room temperature. This example demonstrates the manufacture of a flat, single diamond layer metal abrasive disk.

Example 2

Drill 2.0 mm diameter circular holes on 5 mm centers in a 60° isometric pattern through a 0.2 inch thick by 12 inch wide by 12 inch long stainless steel sheet to form a stencil. Mount the stencil in a sturdy, rigid frame to maintain stencil flatness. Align the stencil over a 1 inch thick by 12 inch wide by 12 inch long pad of smooth-faced urethane rubber. Bring the stencil and rubber pad in laminating contact. Maintain the exposed side of the stencil facing up in a horizontal plane.

Dispense an approximately 0.5 inch diameter, 12 inch long bead of Incusil™ ABA braze paste along one edge of the stencil. Use a 14 inch long, hard rubber squeegee, to draw the bead in a steady speed stroke across the exposed face of the stencil with slight downward pressure and to force the braze paste into the cylindrical cavities to a depth flush with the exposed surface of the stencil, i.e., approximately 0.2 inch. Use only a single pass to prevent braze paste from bleeding under the stencil between perforations.

Lift the stencil vertically away from the face of the rubber pad. Sprinkle a 50/50 vol/vol mixture of 60/80 U.S. mesh diamond and cubic boron nitride abrasive grains from General Electric Company, Columbus, Ohio to evenly dust grains over the rubber pad. Lift the pad from the table and invert to drop excess abrasive grains into a collection pan. Replace the pad with abrasive/paste side up on a horizontal work surface.

Place a spherical steel preform firmly in a manual jig to expose the convex cutting surface of the preform. Press the preform vertically downward against the pad. Apply a slight rolling motion to the sphere to evenly transfer the parcels of abrasive laden brazing paste onto the cutting surface of the preform. Remove the manual jig and fire the preform as in Example 1. This example demonstrates the manufacture of an abrasive tool with a transfer medium according to the present invention. The abrasive tool is useful for grinding concave ball joints.

What is claimed is:

1. A process for making an abrasive tool consisting essentially of the steps of:

(A) providing a stencil having a plurality of perforations of selected shape;

(B) contacting a shaped metal preform, representing a tool body for the abrasive tool, which has been selected from the group consisting of spherical, conical or frustoconical metal preforms, with the stencil whereby the perforations define cavities adjacent a cutting surface on the abrasive tool;

(C) providing a brazing paste including a metal braze composition and a binder component;

(D) filling the cavities with brazing paste;

(E) removing the stencil to form parcels of brazing paste on the cutting surface, each parcel being separated from neighboring parcels by paste-free channels;

(F) depositing abrasive grains onto the parcels; and (G) thermally processing the abrasive tool to braze the abrasive grains to the cutting surface.

2. The invention of claim 1 wherein the filling step includes forcing the brazing paste into the cavities with a straight-edged blade.

3. The invention of claim 2 wherein the abrasive grains are mixed with the brazing paste prior to filling the cavities.

4. The invention of claim 3 wherein the abrasive grains have a particle size of at most 10 $\mu$m.

5. The invention of claim 2 wherein the depositing step includes:

(i) dusting grains onto the cutting surface to embed grains into the parcels; and (ii) removing non-embedded grains.

6. The invention of claim 5 wherein the depositing step further includes pressing the embedded grains into the parcels.

7. The invention of claim 1 wherein the abrasive grains have a particle size of at least about 100 $\mu$m and only one abrasive grain is deposited onto each of most parcels.

8. A process for making an abrasive tool consisting essentially of the steps of:

(A) providing a stencil having a plurality of perforations of selected shape;

(B) contacting a transfer medium with the stencil whereby the perforations define cavities adjacent the transfer medium;

(C) providing a brazing paste including a braze composition and a binder component;

(D) filling the cavities with brazing paste;

(E) removing the stencil to form a patterned face of parcels of brazing paste on the transfer medium, each parcel being separated from neighboring parcels by paste-free channels;

(F) forcing the patterned face against a shaped metal preform, representing a tool body for the abrasive tool, which has been selected from the group consisting of spherical, conical or frustoconical metal preforms, whereby the parcels are transferred to a cutting surface of the abrasive tool;

(G) peeling the transfer medium away to leave the parcels on the cutting surface;

(H) depositing abrasive grains onto the parcels; and (I) thermally processing the abrasive tool to braze the abrasive grains to the cutting surface.

9. The invention of claim 8 wherein the filling step includes forcing the brazing paste into the cavities with a straight-edged blade.

10. The invention of claim 9 wherein the abrasive grains are mixed with the brazing paste prior to filling the cavities.

11. The invention of claim 10 wherein the abrasive grains have a particle size of at most 10 $\mu$m.

12. The invention of claim 9 wherein the depositing step includes:

(i) dusting grains onto the cutting surface to embed grains into the parcels; and (ii) removing non-embedded grains.

13. The invention of claim 12 wherein the depositing step further includes pressing the embedded grains into the parcels.

14. The invention of claim 8 wherein the abrasive grains have a particle size of at least about 100 $\mu$m and only one abrasive grain is deposited onto each of most parcels.

15. The invention of claim 8 wherein the cutting surface is a three dimensional, curvilinear surface and the transfer medium is a flexible, resilient pad.

16. An abrasive tool fabricated by a process comprising the steps of:

(A) providing a stencil having a plurality of perforations of selected shape;

(B) contacting a shaped metal preform selected from the group consisting of flat disk preforms, drill bit core preforms, abrasive wheel rim preforms, saw blade preforms and specialty tool body preforms, with the stencil whereby the perforations define cavities adjacent a cutting surface of the abrasive tool;

(C) providing a brazing paste including a braze composition and a binder component;

(D) filling the cavities with brazing paste;

(E) removing the stencil to form parcels of brazing paste on the cutting surface, each parcel being separated from neighboring parcels by paste-free channels;

(F) depositing abrasive grains onto the parcels; and (G) thermally processing the abrasive tool to braze the abrasive grains to the cutting surface.

17. An abrasive tool fabricated by a process comprising the steps of:

(A) providing a stencil having a plurality of perforations of selected shape;

(B) contacting a transfer medium with the stencil whereby the perforations define cavities adjacent the transfer medium;

(C) providing a brazing paste including a braze composition and a binder component;

(D) filling the cavities with brazing paste;

(E) removing the stencil to form a patterned face of parcels of brazing paste on the transfer medium, each parcel being separated from neighboring parcels by paste-free channels;

(F) forcing the patterned face against a shaped metal preform selected from the group consisting of flat disk preforms, drill bit core preforms, abrasive wheel rim preforms, saw blade preforms and specialty tool body preforms, to transfer the parcels to a cutting surface of the abrasive tool;

(G) peeling the transfer medium away to leave the parcels on the cutting surface;

(H) depositing abrasive grains onto the parcels; and (I) thermally processing the abrasive tool to braze the abrasive grains to the cutting surface.

18. The invention of claim 17 wherein the cutting surface includes a convex, spherical portion.

19. The abrasive tool of claim 16, wherein the abrasive tool is a single diamond layer metal abrasive tool.

20. The abrasive tool of claim 17, wherein the abrasive tool is a single diamond layer metal abrasive tool.

* * * * *